US010065204B2

(12) United States Patent
Neal

(10) Patent No.: US 10,065,204 B2
(45) **Date of Patent: *Sep. 4, 2018**

(54) DUAL FLOW DISPERSER

(71) Applicant: Dennis Neal, Auburn, GA (US)

(72) Inventor: Dennis Neal, Auburn, GA (US)

( * ) Notice: Subject to any disclaimer, the term of this patent is extended or adjusted under 35 U.S.C. 154(b) by 167 days.

This patent is subject to a terminal disclaimer.

(21) Appl. No.: 15/004,082

(22) Filed: Jan. 22, 2016

(65) Prior Publication Data

US 2016/0144386 A1 May 26, 2016

Related U.S. Application Data

(63) Continuation-in-part of application No. 13/767,965, filed on Feb. 15, 2013, now Pat. No. 9,242,787.
(Continued)

(51) Int. Cl.

| | |
|---|---|
| ***B05B 11/00*** | (2006.01) |
| ***B65D 83/20*** | (2006.01) |
| ***B05B 11/04*** | (2006.01) |
| ***B65D 83/42*** | (2006.01) |
| ***B65D 83/44*** | (2006.01) |

(Continued)

(52) U.S. Cl.
CPC ..... *B05B 11/046* (2013.01); *B05B 11/047* (2013.01); *B65D 83/201* (2013.01); *B65D 83/42* (2013.01); *B65D 83/44* (2013.01); *B65D 83/62* (2013.01); *B65D 83/66* (2013.01)

(58) Field of Classification Search
CPC ... B05B 11/046; B05B 11/047; B65D 83/201; B65D 83/42; B65D 83/44; B65D 83/62; B65D 83/66
See application file for complete search history.

(56) References Cited

U.S. PATENT DOCUMENTS 3,033,225 A * 5/1962 Kerr ..... F16K 5/22 137/246.13
3,216,628 A * 11/1965 Fergusson ..... B65D 83/303 222/402.1

(Continued)

OTHER PUBLICATIONS

Notification of Transmittal of the International Search Report and the Written Opinion of the International Searching Authority; PCT Serial No. PCT/US2014/012921; dated May 15, 2014 (Related case, commonly owned).

*Primary Examiner* — Alexander Valvis
*Assistant Examiner* — Christopher R Dandridge
(74) *Attorney, Agent, or Firm* — Bryan W. Bockhop; Bockhop Intellectual Property Law, LLC

(57) ABSTRACT

A disperser system includes a disperser body that defines a substantially air-tight chamber therein. A sprayer assembly includes a passage, a fluid coupling, a nozzle, a valve, a valve trigger and a pouch. The passage is in fluid communication with the chamber. The valve is in fluid communication with both the passage and the fluid coupling and opens to the nozzle. The valve trigger is configured selectively to open the valve, thereby placing the passage and the fluid coupling in fluid communication with the nozzle. The pouch contains a fluid. When the chamber is charged with a gas and when the valve is opened, the gas flows through the passage and the fluid flows through the fluid coupling into the valve so that the gas entrains the fluid and delivers a suspension of the gas and the fluid to the nozzle, out of which the suspension is sprayed.

8 Claims, 5 Drawing Sheets

Related U.S. Application Data

(60) Provisional application No. 61/599,603, filed on Feb. 16, 2012.

(51) Int. Cl.
*B65D 83/62* (2006.01)
*B65D 83/66* (2006.01)

(56) References Cited

U.S. PATENT DOCUMENTS

| | | | | | |
|---|---|---|---|---|---|
| 3,519,167 | A | | 7/1970 | Rast | |
| 5,025,989 | A | | 6/1991 | Spink et al. | |
| 5,251,787 | A | * | 10/1993 | Simson | B67D 1/0462 222/105 |
| 5,875,936 | A | | 3/1999 | Turbett et al. | |
| 5,931,207 | A | * | 8/1999 | Gianino | B05B 9/0805 137/223 |
| 6,942,165 | B1 | * | 9/2005 | Osman | A61K 9/0019 239/337 |
| 7,121,479 | B2 | | 10/2006 | Gressett, Jr. et al. | |
| 9,242,787 | B2 | * | 1/2016 | Fisk | B65D 83/201 |

* cited by examiner

DUAL FLOW DISPERSER

CROSS-REFERENCE TO RELATED APPLICATION(S)

This application is a continuation-in-part of U.S. patent application Ser. No. 13/767,965, filed on Feb. 15, 2013 and issued as U.S. Pat. No. 9,242,787, which claims the benefit of U.S. Provisional Patent Application Ser. No. 61/599,603, filed Feb. 16, 2012, the entirety of both of which is hereby incorporated herein by reference.

BACKGROUND OF THE INVENTION

1. Field of the Invention

The present invention relates to disperser systems and, more specifically, to a system for dispersing fluids.

2. Description of the Related Art

Many different fluids are dispersed in many applications, including spraying adhesives, spraying paint, spraying cooking oils and lubricants, and spraying cleaning and other household chemicals. Many such applications place the fluid to be sprayed in a metal can with a propellant. Many common propellants include volatile chemicals that may be flammable and that are not desirable to be released into the environment. Also, if the propellant falls below a pressure necessary to move the fluid out of the can while there is still fluid in the can, then some of the fluid is wasted. Since many metal spray cans are disposable, this extra fluid (such as in the case with adhesives, paints and industrial chemicals) can become an environmental hazard.

Spraying adhesives presents a challenge because many adhesives have high viscosity levels, sometimes as high as 10,000 cps. With such viscosities, high propellant pressure is usually required to disperse the adhesive in a uniform pattern. Manufacturing spray cans with such high propellant pressures can be challenging.

Therefore, there is a need for a fluid dispersing system that can be recharged and that is reusable and that can spray viscous fluids with relatively low pressure.

SUMMARY OF THE INVENTION

The disadvantages of the prior art are overcome by the present invention which, in one aspect, is a disperser that includes a disperser body. A collapsible pouch contains a fluid. A disperser cap assembly is configured to form a substantially air tight seal with the disperser body so as to define a chamber therein. The pouch is disposed within the chamber and engages the disperser cap assembly. The disperser cap assembly defines a passage in fluid communication with the chamber. The passage is also in fluid communication with a valve disposed in the disperser cap assembly. The disperser cap assembly also includes a coupling in fluid communication with the valve that is configured to fit a portion of the pouch so as to put the valve in fluid communication with the fluid. The valve opens to a nozzle. The chamber is configured to contain a gas at a pressure that is greater than ambient pressure external to the chamber so that the gas in the chamber applies a pressure to the pouch. A valve trigger is configured to fluidly couple the passage and the coupling to the nozzle so that gas from the chamber flows through the passage into the nozzle and so that the fluid flows into the passage and is entrained by the gas flowing through the passage, such that a gas and fluid suspension is forced out of the nozzle. An electrically-driven air pump pumps air from outside of the dispenser body into the chamber.

In another aspect, the invention is a disperser system that includes a disperser body, having a top portion, defining a substantially air-tight chamber therein. A sprayer assembly is disposed adjacent to the top portion. The sprayer assembly includes a passage, a fluid coupling, a nozzle, a valve, a valve trigger and a pouch. The passage is in fluid communication with the chamber. The valve is in fluid communication with both the passage and the fluid coupling and opens to the nozzle. The valve trigger is configured selectively to open the valve, thereby placing the passage and the fluid coupling in fluid communication with the nozzle. The pouch is configured to contain a fluid in fluid communication with the fluid coupling. When the chamber is charged with a gas that has a pressure greater than ambient pressure and when the valve is opened, the gas will flow through the passage and the fluid will flow through the fluid coupling into the valve so that the gas passing through the valve entrains the fluid and delivers a suspension of the gas and the fluid to the nozzle, out of which the suspension is sprayed.

In yet another aspect, the invention is a method of dispersing a fluid, in which the fluid, which is contained in a pouch, is placed into a chamber and the pouch is coupled so that the fluid is in communication with a valve. The chamber is pressurized with a gas. Gas is delivered from the chamber to the valve. The fluid is entrained in the gas at the valve so as to form a suspension of the fluid and the gas. The suspension is delivered to a nozzle from which the suspension is sprayed.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
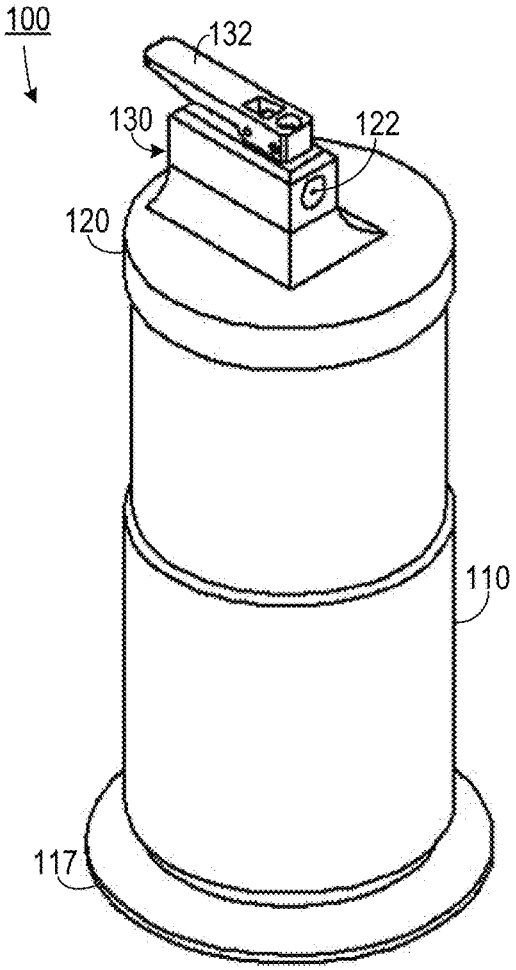
FIG. 1 is a top front perspective view of one embodiment of a disperser.
Figure 2:
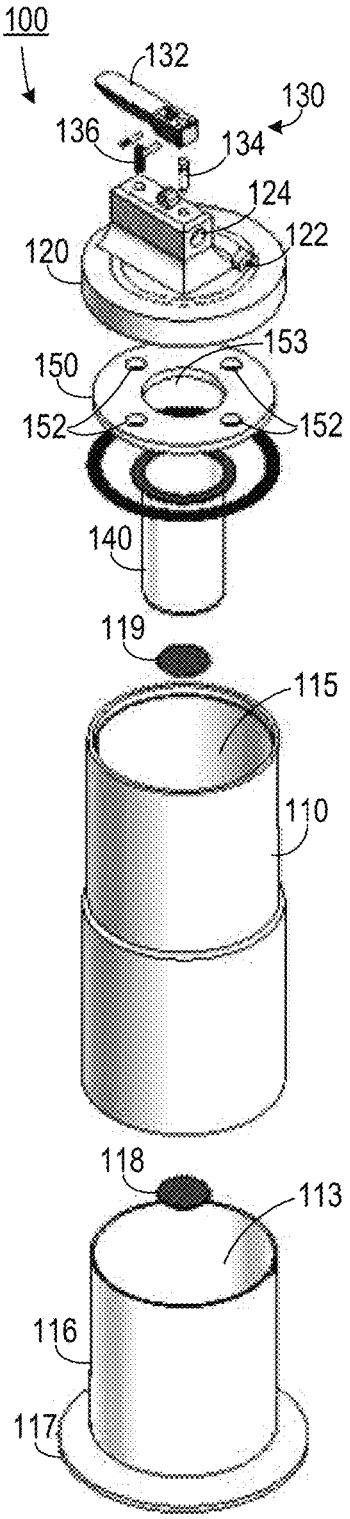
FIG. 2 is an exploded view of the embodiment shown in FIG. 1.
Figure 3:
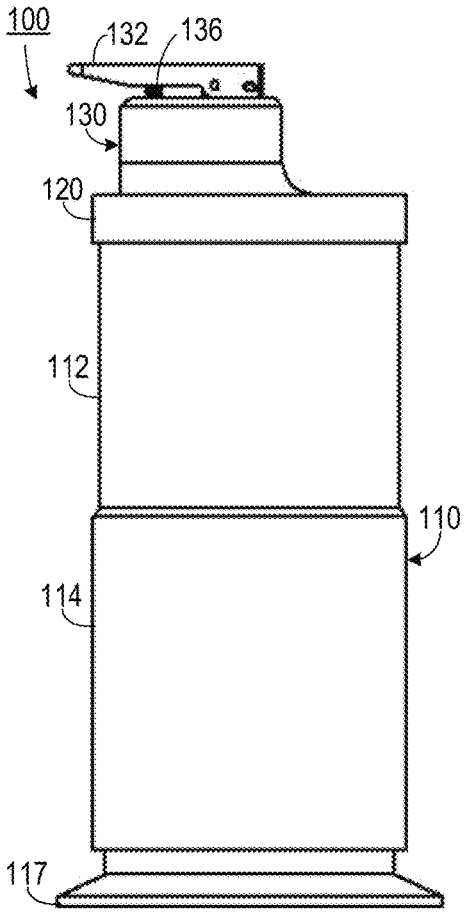
FIG. 3 is a first side elevational view of the embodiment shown in FIG. 1.
Figure 4:
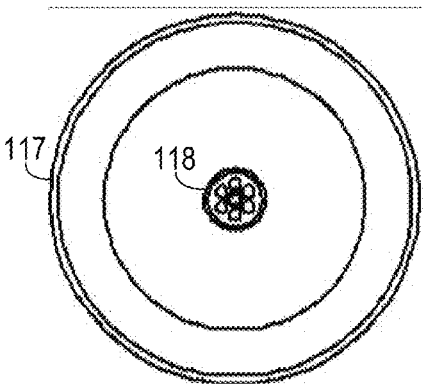
FIG. 4 is a bottom plan view of the embodiment shown in FIG. 1.
Figure 5:
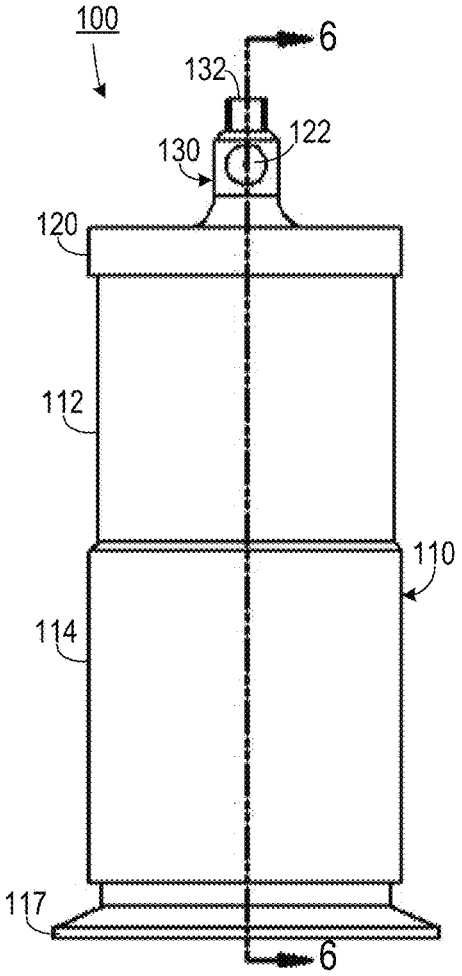
FIG. 5 is a second side elevational view of the embodiment shown in FIG. 1.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "a," "an," and "the" includes plural reference, the meaning of "in" includes "in" and "on."

As shown in FIGS. 1-6, one embodiment of a disperser includes a disperser body 110, having a bottom 117, and a cap assembly 120 that is removably attachable to the disperser body 110. The disperser body 110 and the cap assembly 120 form a substantially air-tight seal with each other and define a chamber 115 therein. A sprayer assembly 130 can be integrated with the cap assembly 120 and includes a sprayer trigger 132 that allows spray of a fluid through a nozzle 122. The trigger 132 allows fluid to spray when depressed and prevents spray of the fluid when in a normal position. A springy member 136, such as a piece of foam or a spring, maintains the trigger 132 in the normal position when not actively being depressed by a user.

A disposable or reusable collapsible fluid pouch 140 is disposed within the chamber 115 and is coupled to the sprayer assembly 130 so that fluid from the pouch 140 can be sprayed through the nozzle 122. A gas is used to charge the chamber 115 so that it has a pressure greater than the ambient air pressure outside of the disperser body 110. A passage 160 puts the chamber 115 in fluid communication with a valve 134 that is controlled by the trigger 132. The valve is also in fluid communication with a coupling 170 that is in fluid communication with the pouch 140. In one embodiment, the coupling 170 (which could be a tube) is configured to fit a portion of the pouch 140 when the cap assembly 120 is pressed downwardly to engage the disperser body 110, thereby placing the coupling 170 in fluid communication with the fluid contained in the pouch 140.

The valve 134 opens to the nozzle 122 so that when the valve 134 is in a fully opened state, both the passage 160 and the coupling 170 are in fluid communication with the nozzle 122. As a result, gas pressure inside the enclosure 115 causes fluid in the collapsible pouch 140 to flow through the coupling 170 toward the valve 134 while gas from the enclosure 115 flows through the passage 160 toward the valve 134. As the gas passes through the valve 134, the Venturi effect draws the fluid from the coupling 170 into the gas stream from the passage 160 so that the gas entrains the fluid and creates a suspension of gas and fluid, which is then dispersed or sprayed out of the nozzle 122.

The sprayer assembly 130 can include a nozzle fitting 124 that is configured to hold the nozzle 122. In this embodiment, the nozzle 122 is replaceable and a plurality of different nozzle types (e.g., with different spray patterns) may be couplable with the nozzle fitting 124.

The pouch 140 may be held in place by a flange 150 that defines an opening 153 that is complimentary in shape to the pouch 140 and that defines a plurality of holes 152 passing therethrough that allow air from the enclosure 115 to flow into the passage 160. The pouch 140 can contain many different types of fluids, such as liquids and powders. The disperser 100 is effective for viscous fluids, such as adhesives, paints and oils because pressure is applied to the pouch 140 while the gas also draws the fluid out using the Venturi effect. This allows for the spraying of viscous fluids with a low pressure propellant. Less viscous fluids, such as insecticides, cleaners and other household liquids may also be used with this system.

In the embodiment shown, the disperser body 110 includes an integrated hand pump assembly to pressurize the enclosure 115 with ambient air. In this embodiment, the disperser body 110 includes a first portion 112 that extends to a second portion 114. The second portion ends in a bottom 111 that includes a first one-way valve 119 (such as a simple flap valve) that allows the passage of air only in an upward direction. Slidably integrated with the second portion 114 is a bottom cup 116 that includes a second one-way valve 118 (also such as a simple flap valve) that also allows the passage of air only in an upward direction. The cup and bottom 111 define a second enclosure 113 therein. When the cup 116 is pushed downwardly, air flows through the second one-way valve 118 into the second enclosure 113 and when the cup 116 is pushed upwardly, that air is forced through the first one-way valve 119 into the main enclosure 115.

In another embodiment, a pressurized gas fitting (not shown) may also be applied to the body 110 to facilitate the connecting of a supply hose from an air compressor or a gas cylinder to pressurize the enclosure 115. A pressure regulator may also be used in association with an air compressor or gas cylinder to achieve an optimal gas pressure. While air can be the gas used as a propellant to pressurize the enclosure 115, other gases can also be used, such as carbon dioxide, nitrogen, helium, steam or one of many other gasses selected to be compatible with the fluid being sprayed. Similarly, a portable air compressor (such as a battery powered compressor) can be affixed to the body 110 and pressurize the enclosure 115 through the gas fitting.

Figures 6, 7:
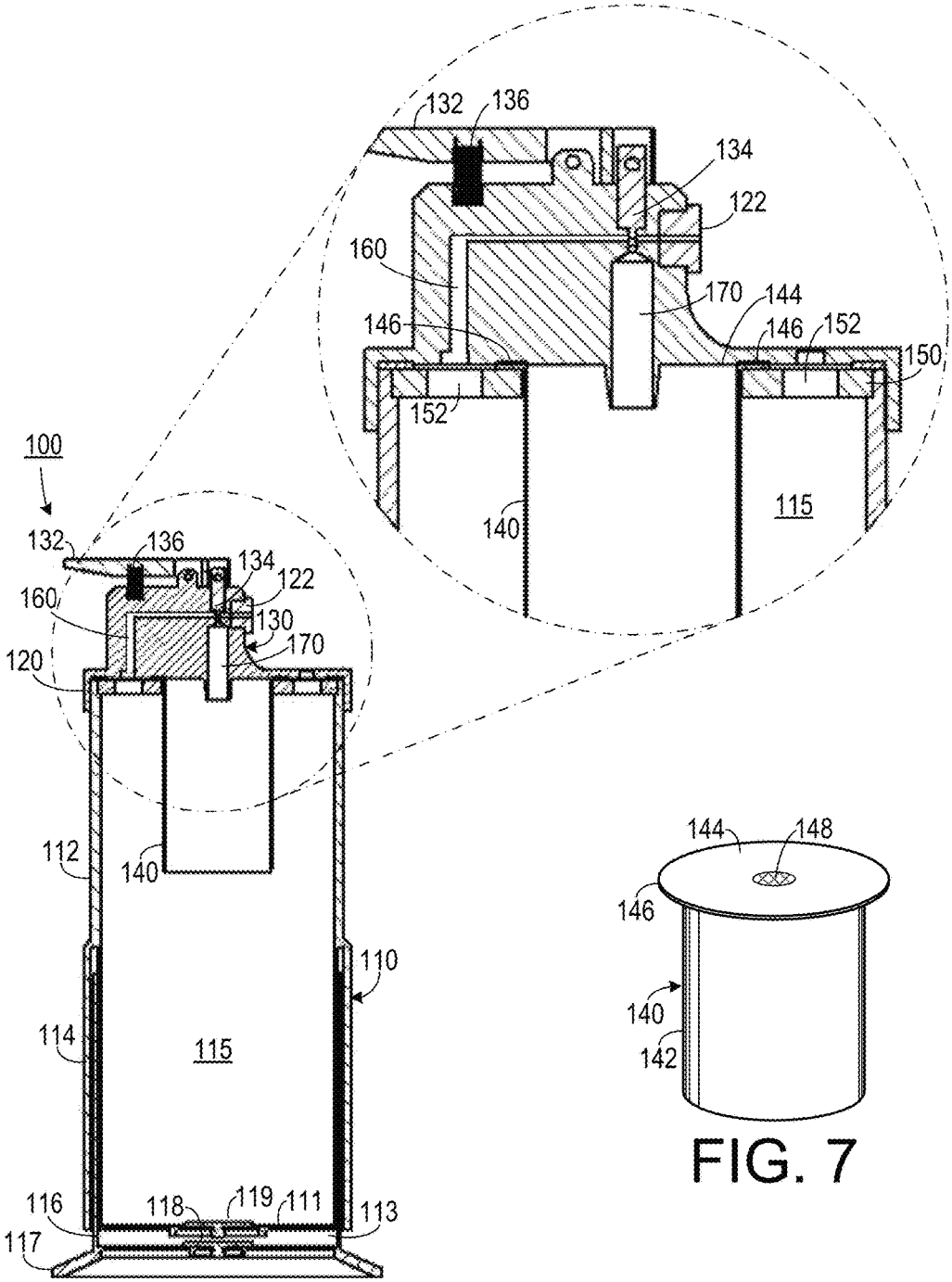
FIG. 6 is a cross sectional view of the embodiment shown in FIG. 5, taken along line 6-6 along with a detail.
FIG. 7 is a top perspective view of a pouch.

As shown in FIG. 7, one embodiment of the pouch 140 includes a collapsible pouch portion 142 that is coupled to a rigid top portion 144. The rigid top portion 144 includes a puncture area 148 that is configured to be easily punctured by the coupling 170. The top portion 144 of the pouch 140 could also be configured to fit the coupling 170, as with a friction fit or a threaded fit. The pouch portion 142 and the top portion 144 could both be made of a plastic that is compatible with the fluid stored therein and the puncture area 148 could be made of a foil. The top portion 144 includes a lip 146 that extends beyond the pouch portion 142 for engagement with the flange 150 and the lid assembly 120. The pouches could be disposable and made of recyclable materials, or they could be reusable.

Figure 8A:
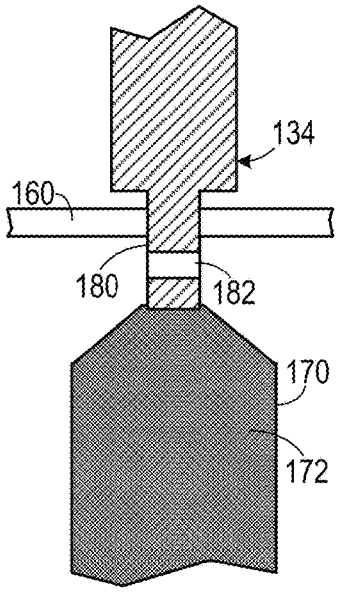
FIGS. 8A-8C are schematic diagrams showing opening of the valve.
Figure 8B:
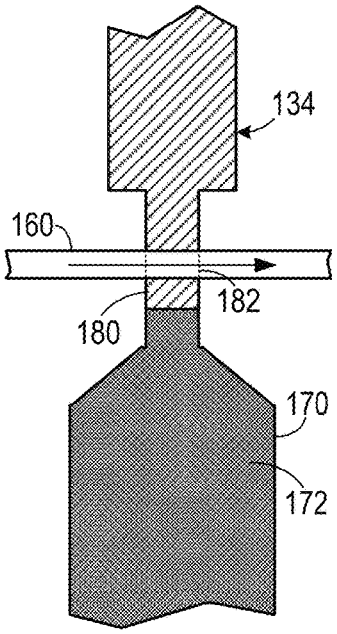
Figure 8C:
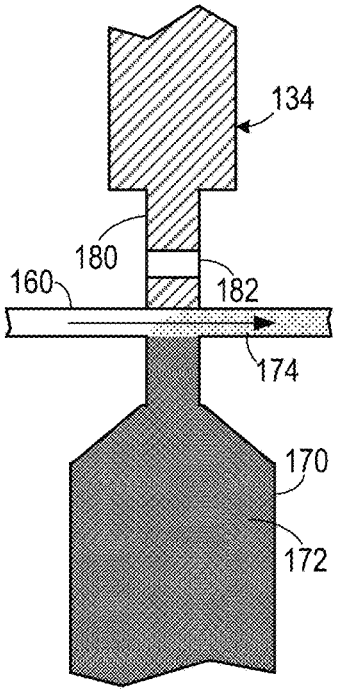

As shown in FIGS. 8A-8C, the valve 134 can include a valve stem 180 that defines a hole 182 therethrough. When the valve 134 is fully closed, as shown in FIG. 8A, no air is allowed to flow through the passage 160 and no fluid 172 is allowed to flow out of the coupling 170. As the valve 134 begins to open, as shown in FIG. 8B, the hole 182 will align with the passage 160 while the valve stem 180 still blocks the coupling 170, allowing only air (or other gas) from the enclosure 115 to pass therethrough. This air will clear the nozzle 122. As the valve 134 continues to move upwardly, as shown in FIG. 8C, the valve stem 182 fully disengages both the passage 160 and the coupling 170, so that the fluid 172 flows upwardly to the passage 160 so that the gas entrains the fluid so as to form the fluid/gas suspension 174. When the spraying ends, this process is reversed so that initially, the fluid flow is cut off while air is still allowed out of the nozzle 122, thereby clearing the nozzle 122, then both the air flow and the fluid 172 flow are cut off.

Figure 9A:
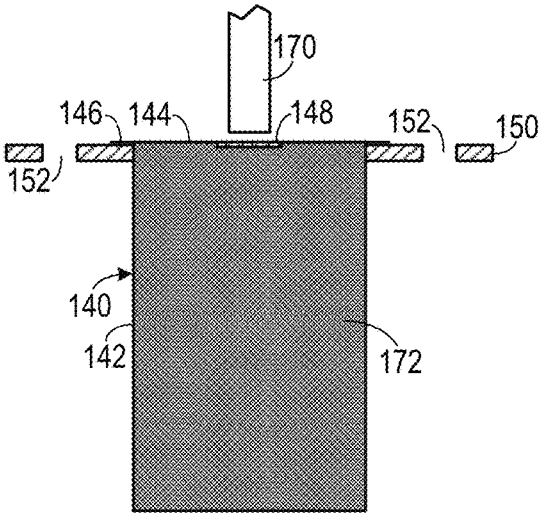
FIGS. 9A-9B are schematic diagrams showing puncturing of the pouch.
Figure 9B:
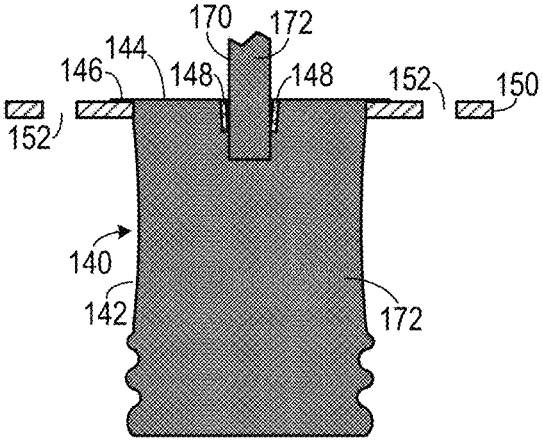

As shown in FIGS. 9A-9B, when a new pouch 140 is placed in the enclosure, the coupling 170 comes down to puncture the puncture area 148. Once the coupling 170 passes into the pouch 140, the fluid 172 flows up through the coupling 170 as the pouch 140 collapses, as shown in FIG. 9B.

This invention is environmentally friendly, as it is reusable, thereby greatly reducing the number of aerosol spray cans that are disposed of in landfills.

It is also safer than many other systems, because the propellant used is typically non-flammable and non-toxic. The use of a disposable pouch reduces the mess from spills and leakage associated with other reusable systems. The system can save considerable amounts of space as a user would not be required to have a separate spray can for each type of material to be sprayed, but only keep separate (much smaller) pouches. Since the system can use lower pressure air, it also results in a reduction of waste particulates that are released into the atmosphere.

In a painting application, for example, a plurality of prefilled pouches may be supplied in which each one has a different paint color mixture. This application would be particularly useful when limited amounts of paint of many different colors are required. For example, in a custom auto body shop, the user would not have to mix different mixtures in limited amounts for customized spray work, but would only need to select a pouch containing the desired color mixture. This would speed up the painting process and would reduce the mess associated with mixing limited amounts of paint.

Figure 10:
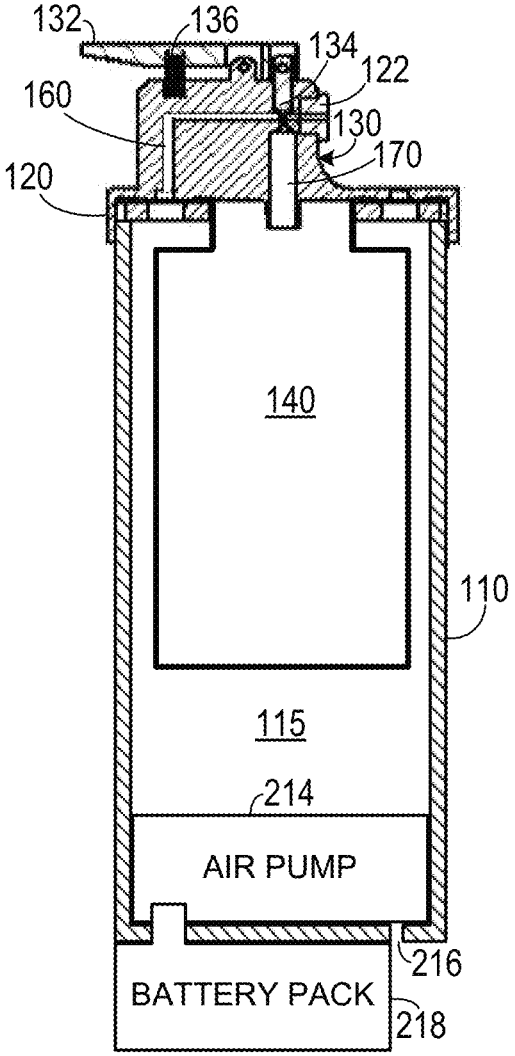
FIG. 10 is a schematic diagram showing an embodiment with an on-board electric air pump.

As shown in FIG. 10, one embodiment incorporates an on-board electrically driven air pump 214 that pumps air into the chamber 115 through a vent 216. The pump 214 can be powered with batteries 218 or it can be directly powered with AC power. The battery pack 218 can be removably attachable to the outside of the dispenser body 110 so that it can be plugged into a battery charger. The on-board electrically driven air pump 214 can be either internal to the compartment cavity 115 or it can be an external unit. The air pump 214 and the battery pack 218 can be part of a single unit. The rechargeable battery 218 and an input port for an AC to DC adapter could be placed in the cavity 115 as well.

This embodiment offers several advantages, including: it eliminates the manual pumping action to pressurize the sprayer; it provides a continuous flow of sprayed product at constant and consistent pressure; it produces a consistent particle size distribution over time; and the replaceable pouch of sprayed liquid can be designed to hold a greater volume than the manual actuated embodiment when used with a dispenser of the same size as the manually actuated embodiment. This is because the manual embodiment must have sufficient void space to collect and hold the pressurized air to compress the pouch and spray out the product. The on-board pump version does not need as much void space.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A disperser system, comprising:

(a) a disperser body, having a top portion, defining a substantially air-tight chamber therein;

(b) a sprayer assembly disposed adjacent to the top portion, the sprayer assembly including:

(i) a passage in fluid communication with the chamber;

(ii) a fluid coupling;

(iii) a nozzle;

(iv) a valve in fluid communication with both the passage and the fluid coupling and opening to the nozzle; and (v) a valve trigger configured selectively to open the valve, thereby placing the passage and the fluid coupling in fluid communication with the nozzle; and (c) a pouch configured to contain a fluid in fluid communication with the fluid coupling; wherein when the chamber is charged with a gas that has a pressure greater than ambient pressure and when the valve is opened, the gas will flow through the passage and the fluid will flow through the fluid coupling into the valve so that the gas passing through the valve entrains the fluid and delivers a suspension of the gas and the fluid to the nozzle, out of which the suspension is sprayed, the valve including an elongated valve stem that passes through the passage, the valve stem including a solid portion that blocks the passage when the solid portion is aligned with the passage, the valve stem defining a hole passing therethrough that allows gas from the chamber to pass through the passage when the hole is aligned with the passage without liquid fluid passing through the passage, the valve trigger configured to place the valve stem into a first position in which the solid portion blocks the passage so as not to allow either gas or liquid fluid to pass into the nozzle, the valve trigger also configured to place the valve stem into a second position in which the hole is aligned with the passage so that gas from the chamber is allowed to pass through the passage without liquid fluid passing therethrough so as to clear the nozzle, the valve trigger also configured to place the valve stem into a third position in which the coupling is in fluid communication with the passage so as to allow both liquid fluid and gas from the chamber to pass into the nozzle; and (d) an electrically-driven air pump that pumps air from outside of the dispenser body into the chamber.

2. The disperser system of claim 1, wherein the electrically-driven air pump is powered by a battery.

3. The disperser system of claim 2, wherein the battery comprises a detachable and rechargeable battery.

4. The disperser system of claim 1, wherein the electrically-driven air pump is disposed within the chamber and is in fluid communication with air outside of the dispenser body through a vent.

5. The disperser system of claim 1, wherein the fluid comprises a fluid selected from a group consisting of: an adhesive; a paint; an oil; an insecticide; a liquid; a powder; and combinations thereof.

6. The disperser system of claim 1, wherein the pouch includes a bottom, a sidewall and a top, wherein the top is configured to be punctured by the coupling when the pouch is placed against the sprayer assembly.

7. The disperser system of claim 1, wherein the gas comprises a gas selected from a group consisting of: air; carbon dioxide; nitrogen; helium and combinations thereof.

8. The disperser system of claim 1, further comprising a fitting in communication with the chamber and configured to allow passage of pressurized gas from a pressurized gas source into the chamber.

* * * * *